US009971296B2

(12) United States Patent
Ishida et al.

(10) Patent No.: US 9,971,296 B2
(45) Date of Patent: May 15, 2018

(54) IMAGE FORMING APPARATUS

(71) Applicant: Konica Minolta, Inc., Tokyo (JP)

(72) Inventors: Takeshi Ishida, Hachioji (JP); Hokuto Hatano, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days. days.

(21) Appl. No.: 15/099,061

(22) Filed: Apr. 14, 2016

(65) Prior Publication Data

US 2016/0320742 A1 Nov. 3, 2016

(30) Foreign Application Priority Data

May 1, 2015 (JP) ..... 2015-093803

(51) Int. Cl.
*G03G 21/00* (2006.01)

(52) U.S. Cl.
CPC ..... *G03G 21/0094* (2013.01)

(58) Field of Classification Search
CPC ..... G03G 21/0094
See application file for complete search history.

(56) References Cited

U.S. PATENT DOCUMENTS

2013/0316277 A1* 11/2013 Konishi ..... G03G 5/14734 430/66
2014/0093294 A1* 4/2014 Komito ..... G03G 21/0094 399/346
2014/0161501 A1* 6/2014 Watanabe ..... G03G 15/0189 399/346
2014/0220488 A1* 8/2014 Hosoya ..... G03G 13/08 430/119.71

FOREIGN PATENT DOCUMENTS

JP 2006039380 A * 2/2006
JP 2008122869 A * 5/2008
JP 2014238437 A 12/2014

OTHER PUBLICATIONS

Mchine translation of Nakai (2008).*
Machine translation of Tokumasu, JP 2006-039380.*

* cited by examiner

*Primary Examiner* — Sevan A Aydin
(74) *Attorney, Agent, or Firm* — Lucas & Mercanti, LLP

(57) ABSTRACT

An image forming apparatus includes a photoreceptor, a charging unit, an exposing unit, a developing unit, a transfer unit, a lubricant supply unit, a cleaning unit and a lubricant removal unit. The lubricant supply unit supplies a lubricant to a surface of the photoreceptor and is disposed at a point which is an upstream side of the cleaning unit and a downstream side of the developing unit in a rotation direction of the photoreceptor. The lubricant removal unit removes the lubricant from the surface of the photoreceptor and is disposed at a point which is the downstream side of the cleaning unit and the upstream side of the developing unit in the rotation direction of the photoreceptor.

8 Claims, 3 Drawing Sheets

PRIOR ART

IMAGE FORMING APPARATUS

FIELD OF THE INVENTION

The present invention relates to an electrophotographic image forming apparatus.

DESCRIPTION OF THE RELATED ART

An electrophotographic image forming apparatus charges the surface of a photoreceptor with discharged electricity, exposes the charged photoreceptor, thereby forming an electrostatic latent image, supplies a toner to the electrostatic latent image, thereby forming a toner image, transfers the toner image onto a transfer material, and fixes the toner image on the transfer material, thereby forming a visible image.

This type of image forming apparatus removes, in order not to badly affect the next image forming process, adhesive substances including the un-transferred toner remaining on the surface of the photoreceptor after transferring the toner image by using a cleaning unit(s).

As the cleaning unit, for example, a cleaning member such as a cleaning blade made of an elastic body such as rubber is generally used.

Further, according to Japanese Patent Application Publication Nos. 2008-122869 and 2014-238437, further performed is to apply a lubricant onto the surface of the photoreceptor, thereby forming a coating layer of the lubricant on the surface of the photoreceptor. This reduces adhesion of the toner to the photoreceptor and also reduces friction resistance between the photoreceptor and the cleaning member, and therefore cleaning performance of the cleaning member can be improved.

As the lubricant, generally, fatty acid metal salt such as zinc stearate is used.

However, in the image forming apparatus, the adhesion amount of the lubricant to the surface of the photoreceptor varies according to the operating environment and the operating history of the image forming apparatus. In particular, when the adhesion amount of the lubricant is large, the amount of the lubricant entering a developing device is large, and hence the charging amount of the toner decreases, and when a white image is formed, the poorly charged toner is developed, which causes fogging in the white image.

BRIEF SUMMARY OF THE INVENTION

The present invention has been made in view of the above circumstances, and objects of the present invention include providing an image forming apparatus which can prevent a lubricant from entering a developing device and accordingly prevent fogging in a white image from occurring.

In order to achieve at least one of the above objects, according to an aspect of the present invention, there is provided an image forming apparatus including: a photoreceptor; a charging unit which charges the photoreceptor; an exposing unit which exposes the charged photoreceptor, thereby forming an electrostatic latent image; a developing unit which develops the electrostatic latent image with a toner, thereby forming a toner image; a transfer unit which transfers the toner image formed on the photoreceptor; a lubricant supply unit which supplies a lubricant to a surface of the photoreceptor; a cleaning unit which removes the toner remaining on the surface of the photoreceptor; and a lubricant removal unit which removes the lubricant from the surface of the photoreceptor, wherein the lubricant contains an organic lubricant and an inorganic lubricant, the lubricant supply unit is disposed at a point which is an upstream side of the cleaning unit and a downstream side of the developing unit in a rotation direction of the photoreceptor, and the lubricant removal unit is disposed at a point which is the downstream side of the cleaning unit and the upstream side of the developing unit in the rotation direction of the photoreceptor.

Preferably, in the image forming apparatus, the inorganic lubricant is made of a substance having cleavage.

Preferably, in the image forming apparatus, the substance having cleavage is at least one of boron nitride, molybdenum disulfide, tungsten disulfide, talc, kaolin, montmorillonite, calcium fluoride and mica.

Preferably, in the image forming apparatus, the organic lubricant is made of fatty acid metal salt.

Preferably, in the image forming apparatus, the fatty acid metal salt is zinc stearate.

Preferably, in the image forming apparatus, the photoreceptor includes a protective layer made of a crosslinked cured resin obtained by polymerization of polymerizable compounds.

Preferably, in the image forming apparatus, the protective layer has a universal hardness of 280 $N/mm^2$ or more and 600 $N/mm^2$ or less.

Preferably, in the image forming apparatus, the charging unit includes a charging roller.

Preferably, in the image forming apparatus, the lubricant removal unit is disposed to contact the surface of the photoreceptor and scrapes off the lubricant by mechanical action.

Preferably, in the image forming apparatus, the lubricant supply unit includes the lubricant which is solid and a lubricant applying member.

Preferably, in the image forming apparatus, a content rate of the inorganic lubricant represented by Mb/(Ma+Mb) is 10 to 50 mass %, wherein Ma represents mass of the organic lubricant, and Mb represents mass of the inorganic lubricant.

BRIEF DESCRIPTION OF THE SEVERAL VIEWS OF THE DRAWING

The present invention is fully understood from the detailed description given hereinafter and the accompanying drawings, which are given byway of illustration only and thus are not intended to limit the present invention, wherein.

DETAILED DESCRIPTION OF THE INVENTION

Hereinafter, the present invention is detailed.

[Image Forming Apparatus]

Figure 1:
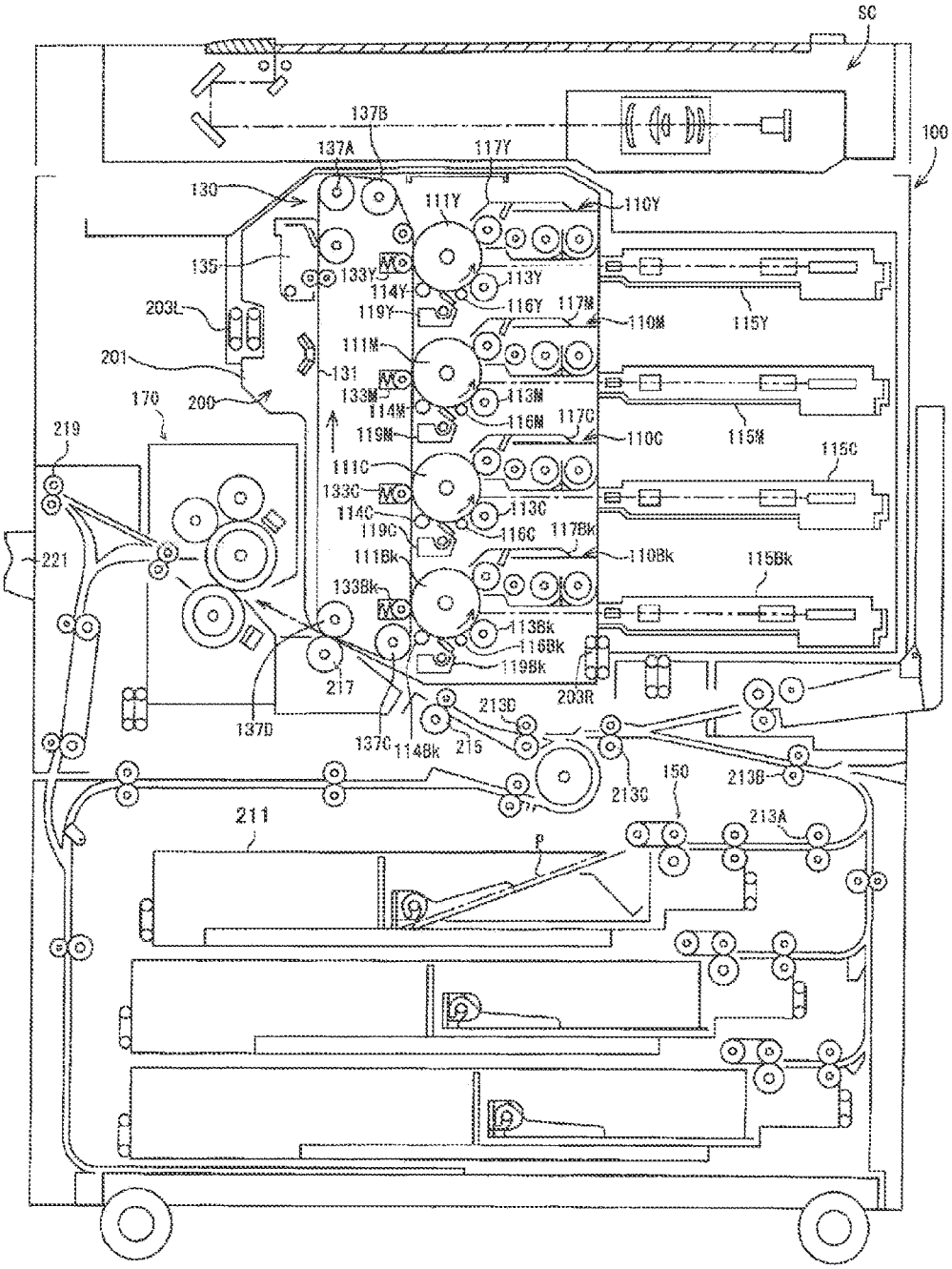
FIG. 1 is a cross-sectional view showing an example of the configuration of an image forming apparatus of the present invention.

FIG. 1 is a cross-sectional view showing an example of the configuration of an image forming apparatus of the present invention.

This image forming apparatus 100 is called a tandem color toner image forming apparatus and includes: four image forming units 110Y, 110M, 110C, 110Bk: an intermediate transfer body unit 130; a paper feeding/carrying unit 150; and a fixing unit 170. At the upper part of the image forming apparatus 100, a document image scanner SC is disposed.

The image forming units 110Y, 110M, 110C, 110Bk are disposed next to one another in a vertical direction. The image forming units 110Y, 110M, 110C, 110Bk include their respective rotary drum-shaped photoreceptors 111Y, 111M, 111C, 111Bk, and also include: their respective charging units 113Y, 113M, 113C, 113Bk; exposing units 115Y, 115M, 115C, 115Bk; developing units 117Y, 117M, 117C, 117Bk; lubricant supply units 114Y, 114M, 114C, 114Bk; cleaning units 119Y, 119M, 119C, 119Bk; and lubricant removal units 116Y, 116M, 116C, 116Bk which are disposed in the named order in regions of the circumferential surfaces of their respective photoreceptors 111Y, 111M, 111C, 111Bk in a rotation direction of the photoreceptors 111Y, 111M, 111C, 111Bk. On the photoreceptors 111Y, 111M, 111C, 111Bk, yellow (Y), magenta (M), cyan (C) and black (Bk) toner images are formed, respectively. The image forming units 110Y, 110M, 110C, 110Bk are the same in configuration except for the colors of the toner images formed on the photoreceptors 111Y, 111M, 111C, 111Bk. Hereinafter, the image forming unit 110Y is described as a representative of the image forming units 110Y, 110M, 110C, 110Bk.

[Photoreceptor]

The photoreceptor 111Y preferably has a protective layer made of a crosslinked cured resin obtained by polymerization of polymerizable compounds. More specifically, the photoreceptor 111Y has a layer structure in which an intermediate layer is formed on a conductive base; a photosensitive layer composed of a charge generating layer containing a charge generating substance and a charge transfer layer containing a charge transfer substance disposed in this order is formed on the intermediate layer; and a protective layer as a surface layer is formed on the photosensitive layer (charge transfer layer). The photosensitive layer may have a layer structure of a single layer containing both the charge generating substance and the charge transfer substance.

[Polymerizable Compounds]

The crosslinked cured resin is composed of crosslinked polymer(s) obtained as follows: irradiate polymerizable compounds each having two or more polymerizable functional groups with actinic rays such as ultraviolet rays or electron beams or heat the polymerizable compounds; and thereby polymerize the polymerizable compounds, and also form crosslinked bond(s) by crosslinking reaction and thereby cure the polymerizable compounds. As the polymerizable compound(s), a compound having two or more polymerizable functional groups is used, and a compound having one polymerizable functional group may be used together. More specifically, examples of the polymerizable compound(s) include styrene monomers, acrylic monomers, methacrylic monomers, vinyltoluene monomers, vinyl acetate monomers and N-vinylpyrrolidone monomers.

It is particularly preferable that the polymerizable compound(s) be an acrylic monomer having two or more acryloyl groups ($CH_2{=}CHCO{-}$) or methacryloyl groups ($CH_2{=}CCH_3CO{-}$) or an oligomer thereof because they can be cured with a small amount of light or in a short period of time.

In the present invention, as the polymerizable compounds, one type thereof may be used, or two or more types thereof may be mixed to use. The polymerizable compounds to use may be monomers or oligomers.

Specific examples of the polymerizable compounds are shown below.

[Chem. 1]

M1

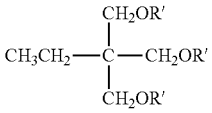

M2

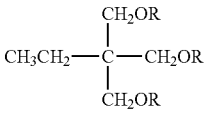

M3

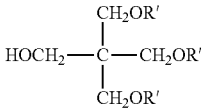

M4

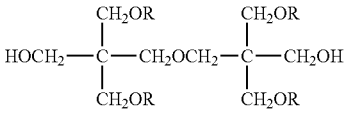

M5

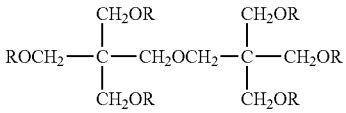

M6

M7

[Chem. 2]

M8

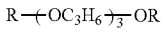

M9

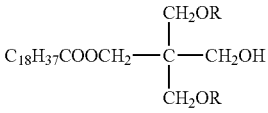

M10

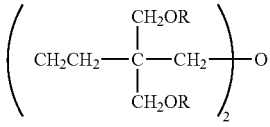

M11

M12

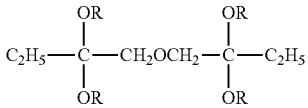

M13

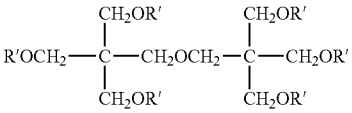

-continued

M14

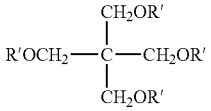

In the chemical formulae representing the above examples M1 to M14, R represents an acryloyl group ($CH_2{=}CHCO{-}$), and R' represents a methacryloyl group ($CH_2{=}CCH_3CO{-}$).

(Metal Oxide Particles)

The protective layer may contain metal oxide particles in view of layer strength and conductivity. The metal oxide particles are preferably surface-treated with a surface treatment agent.

Usable examples of the metal oxide particles include silica (silicon oxide), magnesium oxide, zinc oxide, lead oxide, alumina (aluminum oxide), zirconium oxide, tin oxide, titania (titanium oxide), niobium oxide, molybdenum oxide and vanadium oxide. Among these, tin oxide is preferable in view of hardness, conductivity and optical transparency.

The number average primary particle diameter of the metal oxide particles is preferably 1 to 300 nm, far preferably 3 to 100 nm and still far preferably 5 to 40 nm.

In the present invention, the number average primary particle diameter of the metal oxide particles is a value obtained as follows: 10,000-fold enlarged pictures are taken with a scanning electron microscope (from JEOL Ltd.); and picture images of 300 particles (no aggregated particle included) scanned with a scanner at random are processed/analyzed with an automatic image processing analyzer "LUZEX AP (software Ver. 1.32)" (from Nireco Corporation) so that the number average primary particle diameter is calculated therefrom.

The surface treatment agent preferably reacts with hydroxy group (s) present on the surface of the metal oxide particles, and examples thereof include a silane coupling agent and a titan coupling agent.

The surface treatment agent preferably has radical polymerizable reactive group(s). Examples of the radical polymerizable reactive groups include vinyl groups, acryloyl groups and methacryloyl groups. These radical polymerizable reactive groups react with the polymerizable compounds of the present invention and thereby can form a strong protective layer. The surface treatment agent having radical polymerizable reactive groups is preferably a silane coupling agent having radical polymerizable reactive groups, which are exemplified by vinyl groups, acryloyl groups and methacryloyl groups.

Specific examples of the surface treatment agent are shown below.

S-1: $CH_2{=}CHSi(CH_3)(OCH_3)_2$
S-2: $CH_2{=}CHSi(OCH_3)_3$
S-3: $CH_2{=}CHSiCl_3$
S-4: $CH_2{=}CHCOO(CH_2)_2Si(CH_3)(OCH_3)_2$
S-5: $CH_2{=}CHCOO(CH_2)_2Si(OCH_3)_3$
S-6: $CH_2{=}CHCOO(CH_2)_2Si(OC_2H_5)(OCH_3)_2$
S-7: $CH_2{=}CHCOO(CH_2)_3Si(OCH_3)_3$
S-8: $CH_2{=}CHCOO(CH_2)_2Si(CH_3)\ Cl_2$
S-9: $CH_2{=}CHCOO(CH_2)_2SiCl_3$
S-10: $CH_2{=}CHCOO(CH_2)_3Si(CH_3)\ Cl_2$
S-11: $CH_2{=}CHCOO(CH_2)_3SiCl_3$
S-12: $CH_2{=}C(CH_3)COO(CH_2)_2Si(CH_3)(OCH_3)_2$
S-13: $CH_2{=}C(CH_3)COO(CH_2)_2Si(OCH_3)_3$
S-14: $CH_2{=}C(CH_3)COO(CH_2)_3Si(CH_3)(OCH_3)_2$
S-15: $CH_2{=}C(CH_3)COO(CH_2)_3Si(OCH_3)_3$
S-16: $CH_2{=}C(CH_3)COO(CH_2)_2Si(CH_3)Cl_2$
S-17: $CH_2{=}C(CH_3)COO(CH_2)_2SiCl_3$
S-18: $CH_2{=}C(CH_3)COO(CH_2)_3Si(CH_3)Cl_2$
S-19: $CH_2{=}C(CH_3)COO(CH_2)_3SiCl_3$
S-20: $CH_2{=}CHSi(C_2H_5)(OCH_3)_2$
S-21: $CH_2{=}C(CH_3)Si(OCH_3)_3$
S-22: $CH_2{=}C(CH_3)Si(OC_2H_5)_3$
S-23: $CH_2{=}CHSi(OCH_3)_3$
S-24: $CH_2{=}C(CH_3)Si(CH_3)(OCH_3)_2$
S-25: $CH_2{=}CHSi(CH_3)Cl_2$
S-26: $CH_2{=}CHCOOSi(OCH_3)_3$
S-27: $CH_2{=}CHCOOSi(OC_2H_5)_3$
S-28: $CH_2{=}C(CH_3)COOSi(OCH_3)_3$
S-29: $CH_2{=}C(CH_3)COOSi(OC_2H_5)_3$
S-30: $CH_2{=}C(CH_3)COO(CH_2)_3Si(OC_2H_5)_3$
S-31: $CH_2{=}CHCOO(CH_2)_2Si(CH_3)_2\ (OCH_3)$
S-32: $CH_2{=}CHCOO(CH_2)_2Si(CH_3)(OCOCH_3)_2$
S-33: $CH_2{=}CHCOO(CH_2)_2Si(CH_3)(ONHCH_3)_2$
S-34: $CH_2{=}CHCOO(CH_2)_2Si(CH_3)(OC_6H_5)_2$
S-35: $CH_2{=}CHCOO(CH_2)_2Si(C_{10}H_{21})(OCH_3)_2$
S-36: $CH_2{=}CHCOO(CH_2)_2Si(CH_2C_6H_5)(OCH_3)_2$

As the surface treatment agent, one type thereof may be used, or two or more types thereof may be mixed to use.

The use amount of the surface treatment agent is, to 100 parts by mass of untreated metal oxide particles, preferably 0.1 to 200 parts by mass and far preferably 7 to 70 parts by mass.

As a method for treating the untreated metal oxide particles with the surface treatment agent, for example, wet crushing of slurry (suspension of solid particles) containing the untreated metal oxide particles and the surface treatment agent is used. This method prevents the untreated metal oxide particles from re-aggregating while surface-treating the untreated metal oxide particles. Thereafter, the solvent is removed and powdering is performed.

The content rate of the metal oxide particles in the protective layer is, to 100 parts by mass of the crosslinked cured resin therein, preferably 20 to 170 parts by mass and far preferably 25 to 130 parts by mass.

In addition to the crosslinked cured resin and the metal oxide particles, other components may be contained in the protective layer. For example, an antioxidant of any type can be contained therein, and also lubricant particles of any type can be added thereto. For example, fluorine atom-containing resin particles can be added thereto. As the fluorine atom-containing resin particles, it is preferable to appropriately select at least one type from among: polytetrafluoroethylene resin; polytrifluorochloroethylene resin; chlorohexafluoroethylene propylene resin; vinyl fluoride resin; vinylidene fluoride resin; dichlorodifluoroethylene resin; and copolymers of these. In particular, polytetrafluoroethylene resin and vinylidene fluoride resin are preferable.

The protective layer can be formed as follows: add the polymerizable compounds, the metal oxide particles, a polymerization initiator and other necessary components to a well-known solvent, thereby preparing a protective layer-forming application liquid; apply this application liquid to the circumferential surface of the photosensitive layer (charge transfer layer), thereby forming a coating layer; dry this coating layer; and irradiate the coating layer with actinic rays such as ultraviolet rays or electron beams, thereby polymerizing and curing the polymerizable compounds in the coating layer.

The above-described protective layer is formed as the cured resin composed of the crosslinked polymer(s) obtained by progress of reaction between the polymerizable compounds.

The solvent used for forming the protective layer can be any as long as it can dissolve or disperse the polymerizable compounds and the metal oxide particles. Examples thereof include but are not limited to: methanol, ethanol, n-propyl alcohol, isopropyl alcohol, n-butanol, t-butanol, sec-butanol, benzyl alcohol, toluene, xylene, methylene chloride, methyl ethyl ketone, cyclohexane, ethyl acetate, butyl acetate, methyl cellosolve, ethyl cellosolve, tetrahydrofuran, 1-dioxane, 1,3-dioxolane, pyridine and diethylamine.

As a method for applying the protective layer-forming application liquid, a well-known method can be used. Examples thereof include: dip coating, spray coating, spinner coating, bead coating, blade coating, beam coating, slide hopper and circular slide hopper.

The coating layer may be cured without being dried, but preferably is cured after naturally dried or thermally dried.

The drying conditions can be appropriately selected according to the type of the solvent, the layer thickness and so forth. The drying temperature is preferably room temperature to 180° C. and particularly preferably 80 to 140° C. The drying time is preferably 1 to 200 minutes and particularly preferably 5 to 100 minutes.

The polymerizable compounds are reacted by electron beam cleavage, by light or heat after addition of a radical polymerization initiator, or the like. As the radical polymerization initiator, either a photo-polymerization initiator or a thermal polymerization initiator can be used, or they can be used together.

Examples of the thermal polymerization initiator include: azo compounds such as 2,2'-azobisisobutyronitrile, 2,2'-azobis(2,4-dimethyl-azobis-valeronitrile), and 2,2'-azodi(2-methylbutyronitrile); and peroxides such as benzoyl peroxide (BPO), di-tert-butyl hydroperoxide, tert-butyl hydroperoxide, chlorobenzoyl peroxide, dichlorobenzoyl peroxide, bromomethylbenzoyl peroxide, and lauroyl peroxide.

Examples of the photo-polymerization initiator include: acetophenone or ketal photo-polymerization initiators such as diethoxyacetophenone, 2,2-dimethoxy-1,2-diphenylethan-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-morpholinophenyl)butanone-1 ("Irgacure 369" from BASF Japan Ltd.), 2-hydroxy-2-methyl-1-phenylpropanone-1-one, 2-methyl-2-morpholino (4-methylthiophenyl)propane-1-one, and 1-phenyl-1,2-propanedione-2-(o-ethoxycarbonyl)oxime; benzoin ether photo-polymerization initiators such as benzoin, benzoin methyl ether, benzoin ethyl ether, benzoin isobutyl ether, and benzoin isopropyl ether; benzophenone photo-polymerization initiators such as benzophenone, 4-hydroxybenzophenone, methyl-o-benzoylbenzoate, 2-benzoylnaphthalene, 4-benzoylbiphenyl, 4-benzoylphenylether, acrylated benzophenone, and 1,4-dibenzoylbenzene; and thioxanthone photo-polymerization initiators such as 2-isopropylthioxanthone, 2-chlorothioxanthone, 2,4-dimethylthioxantone, 2,4-diethylthioxantone, and 2,4-dichlorothioxanthone.

Other examples of the photo-polymerization initiator include: ethylanthraquinone, diphenyl(2,4,6-trimethylbenzoyl)phosphine oxide, (2,4,6-trimethylbenzoyl)phenylethoxy phosphine oxide, bis(2, 4, 6-trimethylbenzoyl)-phenylphosphine oxide, bis(2,4-dimethoxybenzoyl)-2,4,4-trimethylpentylphosphine oxide, methyl phenylglyoxylate, 9,10-phenanthrene, acridine compounds, triazine compounds, and imidazole compounds. In addition, a photo-polymerization promoter having a photo-polymerization promoting effect can be used alone or in combination with a photo-polymerization initiator, the examples of which are mentioned above. Examples of the photo-polymerization promoter include triethanolamine, methyldiethanolamine, ethyl 4-(dimethylamino)benzoate, isoamyl 4-(dimethylamino)benzoate, 2-dimethylaminoethyl benzoate, and 4,4'-(dimethylamino)benzophenone.

The radical polymerization initiator is preferably a photo-polymerization initiator. In particular, alkylphenone compounds and phosphine oxide compounds are preferable. Especially, a compound(s) having an α-aminoalkylphenone structure or acylphosphine oxide structure is preferable.

As the polymerization initiator, one type thereof may be used, or two or more types thereof may be mixed to use.

The addition rate of the polymerization initiator is, to 100 parts by mass of the polymerizable compounds, preferably 0.1 to 20 parts by mass and far preferably 0.5 to 10 parts by mass.

The crosslinked polymer(s) is produced as follows: irradiate a coating layer containing polymerizable compounds, described above, with actinic rays; and thereby produce radical(s) and thereby polymerize the polymerizable compounds, and also form crosslinked bond(s) by crosslinking reaction. between molecules and in molecules and thereby cure the polymerizable compounds. The actinic rays are preferably ultraviolet rays or electron beams; in particular, ultraviolet rays due to their easiness in use.

A light source of ultraviolet rays can be any with no limitation, as long as it generates ultraviolet rays. Examples thereof include a low-pressure mercury lamp, a medium-pressure mercury lamp, a high-pressure mercury lamp, an ultrahigh-pressure mercury lamp, a carbon arc lamp, a metal halide lamp, a xenon lamp, and flash (pulse) xenon.

The emission conditions differ depending on the lamp, but the emission amount of actinic rays is usually 5 to 500 $mJ/cm^2$, preferably 5 to 100 $mJ/cm^2$.

The lamp power is preferably 0.1 kW to 5 kW and particularly preferably 0.5 kW to 3 kW.

A source of electron beams can be any electron beam emitter with no special limitation. In general, as an electron beam accelerator for emission of electron beams, an accelerator employing a curtain beam system, which is relatively inexpensive and has a large output, is effectively used. The acceleration voltage in emission of electron beams is preferably 100 to 300 kV. The absorbed dose is preferably 0.5 to 10 Mrad.

The emission time for obtaining the necessary emission amount of actinic rays is preferably 0.1 seconds to 10 minutes, and, in view of work efficiency, far preferably 0.1 seconds to 5 minutes.

In the step of forming the protective layer, the drying can be performed before, after and/or during emission of actinic rays (i.e., irradiation with actinic rays). The timing(s) at which the drying is performed can be determined by appropriately selecting any one or more of the above.

The universal hardness (HU) of the protective layer is preferably 280 $N/mm^2$ or more and 600 $N/mm^2$ or less, and far preferably 500 $N/mm^2$ or more and 600 $N/mm^2$ or less.

The universal hardness of the protective layer within the above range makes the surface of the photoreceptor have high abrasiveness and hence can improve removability of the lubricant by making abrasive power of the below-described lubricant removal unit high. Therefore, an effect of preventing a lubricant from entering a developing unit can be certainly obtained.

In the present invention, the universal hardness of the protective layer is a value measured with a micro hardness tester system "Fischer Scope H100" (from Fischer Instruments K.K.).

More specifically, in the "Fischer Scope H100", a load F as a test load is applied to a Vickers diamond pyramid indenter so as to thrust the indenter into the surface of a photoreceptor, so that an indentation depth h is obtained, and the load F and the indentation depth h are substituted into the following Formula (1).

$$\text{HU(Universal Hardness)}=F/(26.45\times h^2) \qquad \text{Formula (1):}$$

The universal hardness (HU) of the protective layer can be controlled by the curing conditions for forming the protective layer (the emission time of actinic rays (i.e., irradiation time with actinic rays), the type of actinic rays, etc.) and the type of the polymerizable compounds.

The thickness of the protective layer is preferably 0.2 to 10 μm and far preferably 0.5 to 6 μm.

In the photoreceptor of the present invention, the layers except the protective layer can employ various well-known layers.

[Charging Unit]

The charging unit 113Y preferably includes a member which charges the surface of the photoreceptor 111Y with a proximity charging system, in particular, a charging roller.

The proximity charging system is a charging system making use of proximity discharge which occurs at micro gap(s) near the surface of a photoreceptor. Examples of the proximity charging system include a contact roller charging system, a noncontact roller charging system, and a brush charging system.

The charging unit 113Y of this example is constituted of: the charging roller disposed to contact the surface of the photoreceptor 111Y; and a power supply which supplies a voltage to the charging roller.

The charging roller is composed of, for example, a resistance adjustment layer formed on a conductive base.

[Exposing Unit]

The exposing unit 115Y exposes, based on image signals (yellow image signals), the surface of the photoreceptor 111Y having electric potentials uniformly applied by the charging unit 113Y, thereby forming an electrostatic latent image corresponding to a yellow image. The exposing unit 115Y is constituted of an LED array of light-emitting elements disposed in the axis direction of the photoreceptor 111Y and image-forming element(s) or employs a laser optical system.

[Developing Unit]

The developing unit 117Y supplies a toner to the surface of the photoreceptor 111Y so as to develop the electrostatic latent image formed on the surface of the photoreceptor 111Y, thereby forming a toner image. More specifically, the developing unit 117Y of this example is constituted of a developing device which includes: a housing where a developer is housed; a rotary development sleeve disposed in the housing, the sleeve having a built-in magnet and holding the developer; and a voltage supply device which supplies DC and/or AC bias voltage (s) for forming a development electric field between the photoreceptor 111Y and the development sleeve.

[Lubricant Supply Unit]

The lubricant supply unit 114Y supplies a lubricant to the surface of the photoreceptor 111Y. The lubricant supply unit 114Y just need to be disposed at a point which is the upstream side of the cleaning unit 119Y and the downstream side of the developing unit 117Y in the rotation direction of the photoreceptor 111Y, and, in this example, is disposed at a point which is the downstream side of a transfer unit (a primary transfer roller 133Y in this example) and the upstream side of the cleaning unit 119Y in the rotation direction of the photoreceptor 111Y.

Figure 2:
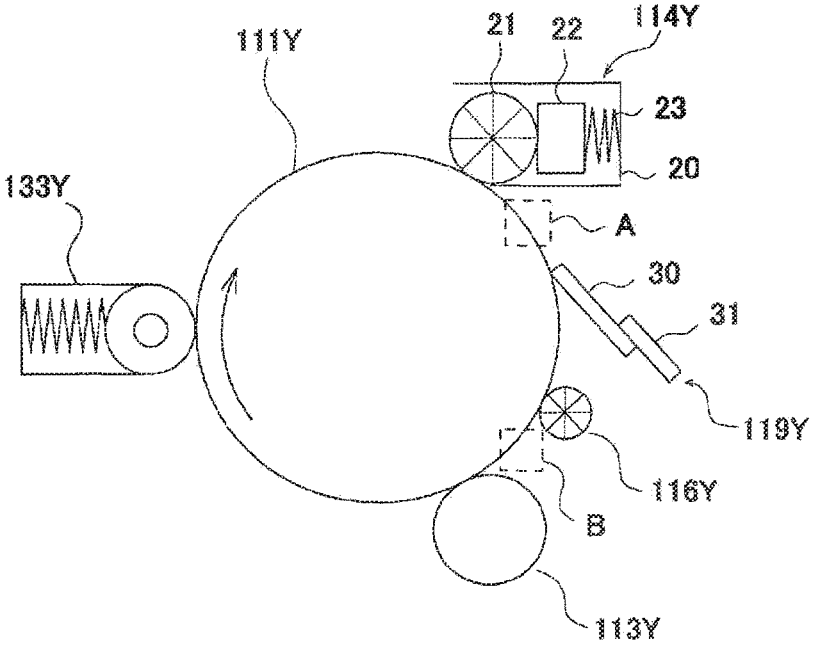
FIG. 2 is a cross-sectional view showing an example of the configuration of the main part of the image forming apparatus of the present invention.

The lubricant supply unit 114Y of this example includes: a solid lubricant; and a lubricant applying member constituted of a brush roller. More specifically, as shown in FIG. 2, the lubricant supply unit 114Y includes: a case 20; and, in the case 20, a lubricant stock 22 composed of a solid cuboid lubricant, a brush roller 21 which abuts the surface of the photoreceptor 111Y and applies the lubricant to the surface of the photoreceptor 111Y, the lubricant being scraped off by the brush roller 21 abrading the surface of the lubricant stock 22, a pressure spring 23 which presses the lubricant stock 22 against the brush roller 21, and a drive mechanism (not shown) which rotationally drives the brush roller 21. The brush roller 21 abuts the surface of the photoreceptor 111Y with the tip of its brush. The brush roller 21 is rotationally driven in the opposite direction to the rotation direction of the photoreceptor 111Y at a constant velocity.

The brush roller 21 is formed such that a long woven fabric is disposed on the circumferential surface of a roller base. The long woven fabric is formed such that brush fibers made of a resin such as polypropylene are planted at high density. The brush roller 21 preferably has a brush fiber thickness of 3 to 7 deniers, a brush fiber length of 2 to 5 mm, a brush fiber electric resistivity of $1\times10^{10}\Omega$ or less, a brush fiber Young's modulus of 1,500 to 9,800 N/mm$^2$, and a brush fiber planting density (the number of brush fibers per unit area) of 50 k to 200 k F/inch$^2$.

The pressure spring 23 presses the lubricant stock 22 in a direction approaching the photoreceptor 111Y such that pressure of the brush roller 21 against the photoreceptor 111Y is 0.5 to 1.0 N, for example.

In the lubricant supply unit 114Y, for example, the pressure of the lubricant stock 22 against the brush roller 21 and the rotation speed of the brush roller 21 are adjusted such that the application amount of the lubricant per 1 cm$^2$ of the surface of the photoreceptor 111Y is $0.5\times10^{-7}$ to $1.5\times10^{-7}$ g/cm$^2$.

The lubricant composing the lubricant stock 22 contains both an organic lubricant and an inorganic lubricant.

[Organic Lubricant]

The organic lubricant contained in the lubricant is preferably fatty acid metal salt, and examples thereof include zinc oleate, zinc stearate, aluminum stearate and calcium stearate. Among these, zinc stearate is preferably used in view of slippage and spreadability.

These may be used individually, or two or more types thereof may be used in combination.

[Inorganic Lubricant]

The inorganic lubricant contained in the lubricant is preferably made of a substance having cleavage, and examples thereof include boron nitride, molybdenum disulfide, tungsten disulfide, talc, kaolin, montmorillonite, calcium fluoride and mica. Among these, boron nitride is preferably used.

These may be used individually, or two or more types thereof may be used in combination.

The content rate of the inorganic lubricant in the lubricant is represented by Mb/(Ma+Mb), wherein Ma represents mass of the organic lubricant, and Mb represents mass of the inorganic lubricant. This content rate is preferably 10 to 50 mass % and far preferably 15 to 25 mass %.

The content rate of the inorganic lubricant in the lubricant being 10 mass % or more enables the lubricant removal unit to sufficiently remove the lubricant, and therefore the effect of preventing a lubricant from entering a developing device can be certainly obtained, whereas the content rate of the inorganic lubricant in the lubricant being 50 mass % or less can ensure the content rate of the organic lubricant in the lubricant, and therefore the cleaning performance can be sufficient.

[Cleaning Unit]

The cleaning unit 119Y removes the remaining toner on the surface of the photoreceptor 111Y. The cleaning unit 119Y of this example is constituted of a cleaning blade. This cleaning blade includes, as shown in FIG. 2, a supporting member 31, and a blade member 30 supported by the supporting member 31 via an adhesive layer (not shown). The blade member 30 is disposed such that the tip thereof faces in the opposite direction (counter direction) to the rotation direction of the photoreceptor 111Y at a point where the tip abuts the surface of the photoreceptor 111Y.

The supporting member 31 is not particularly limited and hence can use any well-known supporting member. Examples thereof include those made of rigid metal, elastic metal, plastic, and ceramic. Among these, rigid metal is preferable.

The blade member 30 may have a multilayer structure of a base layer and an edge layer stacked on top of each other. The base layer and the edge layer are each preferably made of polyurethane. Polyurethane is, for example, produced by reaction of polyol and polyisocyanate, optionally with a crosslinking agent.

[Lubricant Removal Unit]

The lubricant removal unit 116Y removes the lubricant adhering to the surface of the photoreceptor 111Y. The lubricant removal unit 116Y just need to be disposed at a point which is the downstream side of the cleaning unit 119Y and the upstream side of the developing unit 117Y in the rotation direction of the photoreceptor 111Y, and, in this example, is disposed at a point which is the downstream side of the cleaning unit 119Y and the upstream side of the charging unit 113Y in the rotation direction of the photoreceptor 111Y.

The lubricant removal unit 116Y preferably contacts the surface of the photoreceptor 111Y with a removal member and removes (scrapes off) the lubricant by mechanical action. Removing the lubricant by mechanical action means removing the lubricant by mechanically abrading the surface of a photoreceptor. The lubricant removal unit 116Y includes the removal member such as a brush roller or a foamed roller, preferably a brush roller in view of removing power and durability. More specifically, the lubricant removal unit 116Y of this example includes: the removal member constituted of a brush roller which is rotationally driven in the opposite direction to the rotation direction of the photoreceptor 111Y at a constant velocity; and a drive mechanism which rotationally drives the brush roller.

The brush roller as the removal member is, for example, a brush roller formed such that a pile woven fabric, which is formed such that bundles of fibers as a pile yarn are woven into a base fabric, is formed to be a ribbon fabric, and the ribbon fabric is spirally wound and attached to around a metal shaft with the napped surface outside. The brush roller of this example is, for example, formed such that a long woven fabric is disposed on the circumferential surface of a metal shaft. The long woven fabric is formed such that brush fibers made of a resin such as polyester are planted at high density.

The brush hair is, in view of removing power, preferably straight hair which is napped perpendicular to the metal shaft. The yarn used for the brush hair is preferably a filament yarn, and material thereof is a synthetic resin exemplified by 6-nylon, 12-nylon, polyester, acryl, and vinylon. In order to increase conductivity, metal such as carbon or nickel may be compounded thereinto. The thickness of respective brush fibers is preferably 3 to 15 deniers, and the length of brush fibers is preferably 2 to 5 mm. Further, setting the planting density of brush fibers within a range of 40 k to 500 k F/inch$^2$ can ensure rigidity necessary for the removal and also does not create in the brush hair a part where fibers are sparsely planted, and accordingly can prevent non-uniform removal of the lubricant. The electric resistivity of brush fibers is preferably $1\times10^7\Omega$ or less, and the Young's modulus of brush fibers is preferably 1,500 to 9,800 N/mm$^2$. The entry amount of the brush roller into the photoreceptor is preferably 0.5 to 1.5 mm. The rotation speed of the brush roller is, for example, 0.3 to 1.5 in ratio to the rotation speed of the photoreceptor. The rotation direction of the brush roller may be the same as or opposite to the rotation direction of the photoreceptor.

In the image forming apparatus 100 of the present invention, as shown in FIG. 2, a lubricant residual ratio represented by B/A is preferably 0.67 or less, wherein A represents a lubricant abundance rate (atm %) per unit area of the surface of the photoreceptor 111Y after supply of the lubricant by the lubricant supply unit 114Y and before removal of the toner by the cleaning unit 119Y, and B represents a lubricant abundance rate (atm %) per unit area of the surface of the photoreceptor 111Y after removal of the lubricant by the lubricant removal unit 116Y. That is, in the image forming apparatus 100, preferably, the lubricant abundance rates on the surface of the photoreceptor 111Y are adjusted by the lubricant supply unit 114Y and the lubricant removal unit 116Y such that $0.67\geq B/A$ holds.

The lubricant residual ratio being 0.67 or less can certainly prevent the lubricant from entering the developing device as the developing unit 117Y.

As a point where the lubricant abundance rate A is measured, on the surface of the photoreceptor 111Y, any point which is the downstream side of the lubricant supply unit 114Y and the upstream side of the cleaning unit 119Y in the rotation direction of the photoreceptor 111Y can be selected.

As a point where the lubricant abundance rate B is measured, on the surface of the photoreceptor 111Y, any point which is the downstream side of the lubricant removal unit 116Y and the upstream side of the lubricant supply unit 114Y in the rotation direction of the photoreceptor 111Y can be selected. In this example, as shown in FIG. 2, as the point where the lubricant abundance rate B is measured, a point which is the downstream side of the lubricant removal unit 116Y and the upstream side of the charging unit 113Y in the rotation direction of the photoreceptor 111Y is selected.

The lubricant abundance rate (s) is degree of presence of the lubricant per unit area of the surface of the photoreceptor. In the present invention, an abundance rate of metal derived from fatty acid metal salt, which constitutes the organic lubricant contained in the lubricant, on the surface of the photoreceptor measured by electron spectroscopy for chemical analysis (ESCA) is used as a substitution amount. The ratio of fatty acid metal salt to the inorganic lubricant in the lubricant is considered to be approximately constant over time. Hence, the abundance rate of metal derived from fatty acid metal salt can be used as the substitution amount for the lubricant abundance rate of the whole lubricant. The unit is "atm %". Selective elements to detect are (i) elements (C, O, etc.) of the crosslinked polymer (s) of the protective layer, (ii) metal oxide (Sn, etc.) of the protective layer and (iii) metal (Zn, Al, etc.) derived from fatty acid metal salt supplied to the surface of the photoreceptor. As the selective elements, all the elements which could be present on the surface of the photoreceptor, different depending on the type of the materials constituting the protective layer and the type of the lubricant to use, need to be extracted. In view of detectability, namely, in order to distinguish metal derived from metal oxide contained in the protective layer from metal derived from fatty acid metal salt, metal oxide used in the protective layer and fatty acid metal salt used as the organic lubricant are selected to be different in type of metal.

More specifically, from the photoreceptor, only the protective layer is cut to be 5 mm square, and using this as a measurement sample, the selective elements are subjected to quantitative analysis with an X-ray photoelectron spectrometer "K-Alpha" (from Thermo Fisher Scientific Inc.) under the following measurement conditions so as to calculate surface element density from each atomic peak area by using a relative sensitivity factor. The measured amount of the detected metal derived from fatty acid metal salt is used as the substitution amount.

—Measurement Conditions—

X rays: Al monochromatic X-ray source
Acceleration: 12 kV, 6 mA
Resolution: 50 eV
Beam system: 400 μm
Step size: 0.1 eV The lubricant abundance rate A can be controlled by the supply method and the supply amount of the lubricant of the lubricant supply unit. The lubricant abundance rate B can be controlled by the type and the contact state of the removal member of the lubricant removal unit.

The intermediate transfer body unit 130 is disposed to abut the photoreceptors 111Y, 111M, 111C, 111Bk. The intermediate transfer body unit 130 includes: an endless belt-shaped intermediate transfer body 131; primary transfer rollers 133Y, 133M, 133C, 133Bk as primary transfer units which are disposed to abut the intermediate transfer body 131 and transfer the toner images formed on the photoreceptors 111Y, 111M, 111C, 111Bk to the intermediate transfer body 131; and a cleaning unit 135 for the intermediate transfer body 131.

The image forming apparatus 100 employs an intermediate transfer system of: transferring the toner images formed on the photoreceptors 111Y, 111M, 111C, 111Bk to the intermediate transfer body 131 using the primary transfer rollers 133Y, 133M, 133C, 133Bk; and transferring the toner images transferred to the intermediate transfer body 131 to a transfer material P using a secondary transfer roller 217 as a secondary transfer unit. However, the image forming apparatus 100 may employ a direct transfer system of directly transferring toner images formed on photoreceptors to a transfer material using transfer units.

The intermediate transfer body 131 is wound around a plurality of rollers 137A, 137B, 137C, 137D and supported thereby to rotate.

In the image forming apparatus 100, the photoreceptor 111Y, the developing unit 117Y, the lubricant supply unit 114Y, the cleaning unit 119Y, the lubricant removal unit 116Y and so forth may be integrated to be a process cartridge (image forming unit) attachable/detachable to/from the image forming apparatus 100. Alternatively, the photoreceptor 111Y and at least one component selected from the charging unit 113Y, the exposing unit 115Y, the developing unit 117Y, the lubricant supply unit 114Y, the lubricant removal unit 116Y, the primary transfer roller 133Y and the cleaning unit 119Y may be integrated to be a process cartridge (image forming unit).

The process cartridge 200 includes: a case 201; the photoreceptor 111Y, the charging unit 113Y, the developing unit 117Y, the lubricant supply unit 114Y, the cleaning unit 119Y and the lubricant removal unit 116Y which are housed in the case 201; and the intermediate transfer body unit 130. The image forming apparatus 100 is provided with support rails 203L, 203R as a guide unit which guides the process cartridge 200 into the image forming apparatus 100. Thereby, the process cartridge 200 is attachable/detachable to/from the image forming apparatus 100. The process cartridges 200 for the respective colors may be a single image forming unit configured to be attachable/detachable to/from the image forming apparatus 100.

The paper feeding/carrying unit 150 is disposed to carry transfer materials P stored in paper feeder cassettes 211 to the secondary transfer roller 217 via a plurality of intermediate rollers 213A, 213B, 213C, 213D and a resist roller 215.

The fixing unit 170 performs fixing on color toner images transferred onto the transfer materials P by the secondary transfer roller 217. Paper ejection rollers 219 are disposed to secure the transfer materials P from both sides and place them on a paper receiving tray 221.

The image forming apparatus 100 thus configured forms toner images with the image forming units 110Y, 110M, 110C, 110Bk. More specifically, the charging units 113Y, 113M, 113C, 113Bk discharge electricity to the surfaces of the photoreceptors 111Y, 111M, 111C, 111Bk so as to negatively charge the surfaces thereof. Next, the exposing units 115Y, 115M, 115C, 115Bk expose the surfaces of the photoreceptors 111Y, 111M, 111C, 111Bk based on image signals, thereby forming electrostatic latent images. Next, the developing units 117Y, 117M, 117C, 117Bk supply toners to the surfaces of the photoreceptors 111Y, 111M, 111C, 111Bk so as to develop the electrostatic latent images, thereby forming toner images.

Then, the primary transfer rollers 133Y, 133M, 133C, 133Bk abut the rotating intermediate transfer body 131 and successively transfer the toner images formed on the photoreceptors 111Y, 111M, 111C, 111Bk onto the rotating intermediate transfer body 131 as a color toner image (primary transfer). In the image forming process, the primary transfer roller 133Bk always abuts the photoreceptor 111Bk (i.e., when form not only color toner images but also monochrome toner images or the like), whereas the other primary transfer rollers 133Y, 133M, 133C abut their respective photoreceptors 111Y, 111M, 111C only when form color toner images.

After the primary transfer rollers 133Y, 133M, 133C, 133Bk are separated from the intermediate transfer body 131, the lubricant supply units 114Y, 114M, 114C, 114Bk supply the lubricant to the surfaces of the photoreceptors 111Y, 111M, 111C, 111Bk. Thereafter, the cleaning units 119Y, 119M, 119C, 119Bk remove the remaining toners on the surfaces of the photoreceptors 111Y, 111M, 111C, 111Bk. Then, the lubricant removal units 116Y, 116M, 116C, 116Bk remove the remaining lubricant on the surfaces of the photoreceptors 111Y, 111M, 111C, 111Bk. Thereafter, for the next image forming process, electricity removal units (not shown) remove electricity from the surfaces of the photoreceptors 111Y, 111M, 111C, 111Bk as needed, and then the charging units 113Y, 113M, 113C, 113Bk negatively charge the surfaces of the photoreceptors 111Y, 111M, 111C, 111Bk.

Meanwhile, a transfer material P (e.g., a supporting medium, such as plain paper or a transparent sheet, to support the final image) stored in a paper feed cassette 211 is fed and carried by the paper feeding/carrying unit 150 to the secondary transfer roller 217 via the intermediate rollers 213A, 213B, 213C, 213D and the resist roller 215. Then, the secondary transfer roller 217 abuts the rotating intermediate transfer body 131 and thereby transfers the color toner image onto the transfer material P (secondary transfer). The secondary transfer roller 217 abuts the intermediate transfer body 131 only when secondary-transfers the color toner image onto the transfer material P. Thereafter, the transfer material P having the color toner image is released at a point where the curvature of the intermediate transfer body 131 is high.

This transfer material P having the color toner image is subjected to fixing at the fixing unit 170, and then secured from both sides by the paper ejection rollers 219 and placed thereby on the paper receiving tray 221 outside the image forming apparatus 100. After the transfer material P having the color toner image is released from the intermediate transfer body 131, the cleaning unit 135 removes the remaining toner on the intermediate transfer body 131.

Thus, according to the image forming apparatus 100 of the present invention, the lubricant removal units 116Y, 116M, 116C, 116Bk, which remove the lubricant, are disposed at respective points which are the downstream side of the cleaning units 119Y, 119M, 119C, 119Bk and the upstream side of the developing units 117Y, 117M, 117C, 117Bk in the rotation direction of the photoreceptors 111Y, 111M, 111C, 111Bk, whereby the lubricant is mechanically removed, and further the lubricant contains the organic lubricant and the inorganic lubricant, whereby the removability of the lubricant by the lubricant removal units 116Y, 116M, 116C, 116Bk can be improved. This prevents the lubricant from entering the developing devices as the developing units 117Y, 117M, 117C, 117Bk and accordingly prevents fogging in white image(s) from occurring.

The reason why the lubricant containing the organic lubricant and the inorganic lubricant can improve the removability of the lubricant is not clear in detail, but is assumed as follows: the organic lubricant has outstanding spreadability and application properties, so that a homogeneous layer can be formed on a photoreceptor, whereas the inorganic lubricant does not have outstanding spreadability, so that the state of the inorganic lubricant dispersed in the layer of the organic lubricant is created, which improves releasability of the coating layer of the lubricant from the photoreceptor.

[Toner]

The toner(s) used in the image forming apparatus of the present invention is not particularly limited, and hence may be composed of toner particles containing a binder resin and a colorant. The toner particles may also contain other components such as a releasing agent as needed.

The toner particles composing the toner preferably have a volume average particle diameter of 2 to 8 μm in order to increase image quality.

A method for producing the toner is not particularly limited, and examples thereof include: a conventional grinding method; a wet melting-and-spherically-shaping method to produce a toner in a dispersion liquid; and well-known polymerization methods such as suspension polymerization, dispersion polymerization, and an emulsion polymerization and aggregation method.

To the toner particles, as external additives, inorganic particles of silica, titania or the like having an average particle diameter of about 10 to 300 nm and an abrasive having an average particle diameter of about 0.2 to 3 μm can be added at proper amounts.

The toner may be used as a magnetic or nonmagnetic one-component developer or may be used as a two-component developer mixed with a carrier.

In the case of the toner used as a two-component developer, the carrier may be composed of magnetic particles made of a well-known material. Examples thereof include: ferromagnetic metal such as iron; alloys of ferromagnetic metal with aluminum, lead and the like; and ferromagnetic metal compounds such as ferrite and magnetite. Among these, ferrite is preferable.

In the above, an embodiment of the present invention is detailed. However, the present invention is not limited thereto, and hence various modifications can be made thereon.

Figure 3:
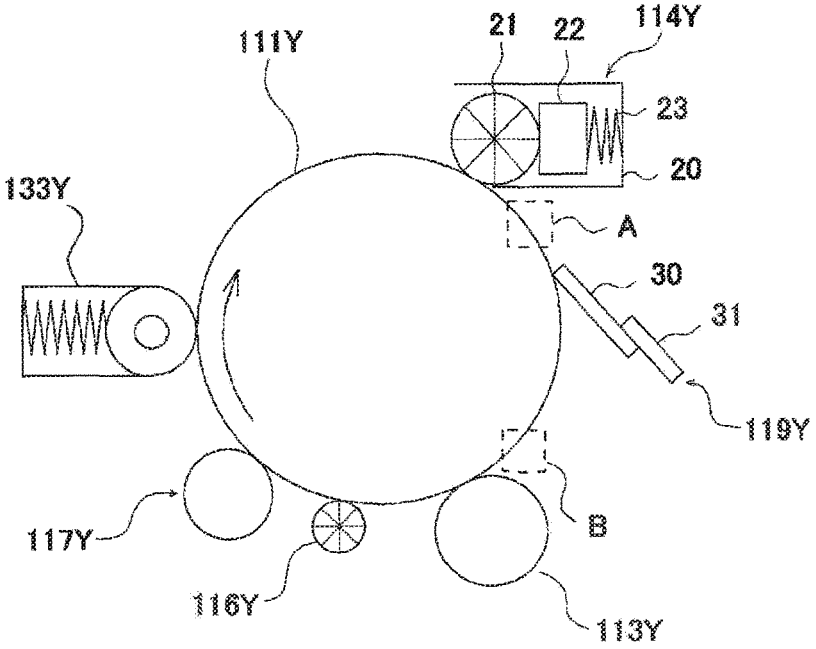
FIG. 3 is a cross-sectional view showing another example of the configuration of the main part of the image forming apparatus of the present invention.

For example, the lubricant removal unit is not limited to being disposed at a point which is the downstream side of the cleaning unit and the upstream side of the charging unit in the rotation direction of the photoreceptor. More specifically, as shown in FIG. 3, the lubricant removal unit 116Y may be disposed at a point which is the downstream side of the charging unit 113Y and the upstream side of the developing unit 117Y in the rotation direction of the photoreceptor 111Y.

Further, the above-described effects can also be obtained by the image forming apparatus equipped with the photoreceptor(s) having the surface layer made of a thermoplastic resin and having a universal hardness of about 150 to 280 $N/mm^2$. The effects can also be obtained by the image forming apparatus equipped with the photoreceptor(s) made of amorphous silicon.

EXAMPLES

Hereinafter, the present invention is described with Examples. However, the present invention is not limited thereto.

Manufacturing Example 1 of Photoreceptor

The surface of a cylindrical aluminum body having a diameter of 60 mm was subjected to cutting work, whereby a conductive base [1] having a finely-cut rough surface was prepared.

(Formation of Intermediate Layer)

A dispersion liquid of the below composition was diluted double with the same solvent as the below solvent, still stood over night and then filtrated (used filter: Rigimesh, 5 μm filter, from PALL Corporation), whereby an intermediate layer-forming application liquid [1] was prepared.

Binder resin: polyamide resin "CM8000" (from TORAY Group) 1 part(s)

Metal oxide particles: titanium oxide "SMT500SAS" (from TAYCA Corporation) 3 parts Solvent: methanol 10 parts Dispersion was performed with a batch method for 10 hours using a sand mill as a disperser.

The intermediate layer-forming application liquid [1] was applied onto the conductive base [1] by dip coating, whereby an intermediate layer [1] having a dry thickness of 2 μm was formed.

(Formation of Charge Generating Layer)

20 parts of the below-described pigment (CG-1) as a charge generating substance, 10 parts of polyvinyl butyral resin #6000-C" (from Denki Kagaku Kogyo Kabushiki Kaisha) as a binder resin, 700 parts of t-butyl acetate as a solvent and 300 parts of 4-methoxy-4-methyl-2-pentanone as another solvent were mixed, and dispersed for 10 hours using a sand mill, whereby a charge generating layer-forming application liquid [1] was prepared. This charge generating layer-forming application liquid [1] was applied onto the intermediate layer [1] by dip coating, whereby a charge generating layer [1] having a dry thickness of 0.3 μm was formed.

<Synthesis of Pigment (CG-1)>

(1) Synthesis of Amorphous Titanyl Phthalocyanine 29.2 parts of 1,3-diiminoisoindoline was dispersed in 200 parts of o-dichlorobenzene, 20.4 parts of titanium tetra-n-butoxide was added thereto, and the resulting product was heated at 150 to 160° C. for 5 hours under nitrogen atmosphere. After cooling, the educed crystal was filtrated, washed with chloroform, washed with 2% hydrochloric acid aqueous solution, washed with water, washed with methanol and then dried, whereby 26.2 parts (yield of 91%) of coarse titanyl phthalocyanine was obtained.

Next, the coarse titanyl phthalocyanine was stirred in 250 parts of concentrated sulphuric acid at 5° C. or lower for 1 hour so as to be dissolved, and the resulting product was poured in 5,000 parts of 20° C. water. The educed crystal was filtrated and well washed with water, whereby 225 parts of a wet paste product was obtained.

This wet paste product was frozen in a refrigerator, and after unfrozen again, filtrated and dried, whereby 24.8 parts (yield of 86%) of amorphous titanyl phthalocyanine was obtained.

(2) Synthesis of (2R,3R)-2,3-Butanediol-Added Titanyl Phthalocyanine (CG-1)

10.0 parts of the amorphous titanyl phthalocyanine and 0.94 parts (equivalent ratio of 0.6; hereinafter the "equivalent ratio" is an equivalent ratio to titanyl phthalocyanine) of (2R,3R)-2,3-butanediol were mixed in 200 parts of orthochlorobenzene (ODB), and heated and stirred at 60 to 70° C. for 6 hours. After the reaction liquid was left over night, methanol was added thereto, the resulting crystal was filtrated, and the filtrated crystal was washed with methanol, whereby 10.3 parts of CG-1 (pigment containing (2R,3R)-2,3-butanediol-added titanyl phthalocyanine) was obtained. In X-ray diffraction spectrum of the pigment (CG-1), clear peaks existed at 8.3°, 24.7°, 25.1° and 26.5°. In mass spectrum thereof, peaks existed at 576 and 648, and in IR spectrum thereof, absorption of Ti═O occurred around 970 $cm^{-1}$, and absorption of O—Ti—O occurred around 630 $cm^{-1}$. In thermogravimetric analysis (TG) thereon, about 7% reduction in mass occurred at 390 to 410° C. Hence, it was assumed that the obtained pigment (CG-1) was a mixture of a 1:1 adduct of titanyl phthalocyanine and (2R,3R)-2,3-butanediol and a non-adduct of titanyl phthalocyanine (i.e., (2R,3R)-2,3-butanediol was not added).

The BET specific surface area of the obtained pigment (CG-1) was measured with an automatic specific surface area measurement device using the flowing gas method (Micrometrics FlowSorb from Shimadzu Corporation), and it was 31.2 $m^2/g$.

(Formation of Charge Transfer Layer)

225 parts of the below compound A as a charge transfer substance, 300 parts of polycarbonate resin "Z300" (from Mitsubishi Gas Chemical Company, Inc.) as a binder resin, 6 parts of "Irganox 1010" (from Ciba-Geigy Japan Limited) as an antioxidant, 1,600 parts of THF (tetrahydrofuran) as a solvent, 400 parts of toluene as another solvent and 1 part (s) of silicone oil "KF-50" (from Shin-Etsu Chemical Co., Ltd) were mixed and dissolved, whereby a charge transfer layer-forming application liquid [1] was prepared.

This charge transfer layer-forming application liquid [1] was applied onto the charge generating layer [1] using a circular slide hopper applying device, whereby a charge transfer layer [1] having a dry thickness of 20 μm was formed.

[Chem. 3]

[Compound A]

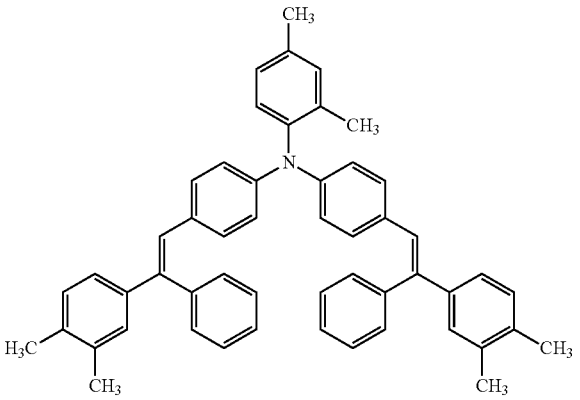

(Formation of Protective Layer)

(1) Production of Metal Oxide Particles

A mixed liquid of 100 parts of tin oxide (number average primary particle diameter: 20 nm), 30 parts of the above compound S-13 as a surface treatment agent and 300 parts of a mixed solvent of toluene/isopropyl alcohol=1/1 (mass ratio) were poured in a sand mill together with zirconia beads, and stirred at about 40° C. at a rotation speed of 1,500 rpm. The treated mixture was taken out, and poured in a Henschel mixer and stirred at a rotation speed of 1,500 rpm for 15 minutes, and thereafter dried at 120° C. for 3 hours. Thus, surface treatment of tin oxide with a compound having radical polymerizable functional group(s) was completed, and hence surface-treated tin oxide was obtained. This was used as metal oxide particles [1]. By this surface treatment with a compound having radical polymerizable functional group(s), the surface of the particles of the tin oxide was coated with the above compound S-13.

(2) Formation of Protective Layer 100 parts of the metal oxide particles [1], 100 parts of the above compound M1 as polymerizable compounds, 320 parts of sec-butanol as a solvent and 80 parts of THF (tetrahydrofuran) as another solvent were mixed under light shielding, and dispersed for 5 hours using a sand mill as a disperser. Thereafter, 10 parts of "Irgacure" (from BASF Japan Ltd.) as a polymerization initiator was added thereto, and stirred under light shielding to be dissolved, whereby a protective layer-forming application liquid [1] was prepared. This protective layer-forming application liquid [1] was applied onto the charge transfer layer [1] using a circular slide hopper applying device, whereby a coating layer was formed. Thereafter, this coating layer was dried at room temperature for 15 minutes, and irradiated with ultraviolet rays for 1 minute under nitrogen stream using a xenon lamp at a lamp output of 1 kW with a distance of 10 mm between the light source and coating layer, whereby a protective layer [1] having a dry thickness of 3.0 μm was formed, and accordingly a photoreceptor [1] was manufactured.

Example 1

An image forming apparatus "bizhub C6500" (from Konica Minolta, Inc.) was equipped with the photoreceptor(s) [1] and a predetermined developer, and an image forming unit(s) was modified to employ a contact roller charging system so as to perform proximity charge, and a lubricant removal unit(s) of the below specifications was disposed at a point which was the downstream side of a cleaning unit and the upstream side of a developing unit in the rotation direction of the photoreceptor [1]. The following conditions were set for this lubricant removal unit. In this image forming apparatus, a lubricant supply unit (s) having a solid lubricant stock and a brush roller was disposed at a point which was the upstream side of the cleaning unit and the downstream side of the developing unit in the rotation direction of the photoreceptor [1]. As the lubricant stock, 90 mass % of fatty acid metal salt (zinc stearate) and 10 mass % of an inorganic lubricant (boron nitride) homogenously mixed and molded were used. This test machine was used for the below-described evaluation of occurrence of fogging in a solid white image. The result is shown in TABLE 1.

—Specifications of Lubricant Removal Unit—

As the lubricant removal unit, a removal member constituted of a straight-hair type brush roller was used. Using carbon-containing nylon fibers "SA-7" (from TORAY Corporation) as a filament yarn, this brush roller was formed such that a ribbon fabric having a brush fiber thickness of 10 deniers, a brush fiber planting density of 75 k F/inch$^2$ and a brush fiber length of 3.0 mm was spirally wound around a metal shaft (SUM22) having an outer diameter of 6 mm. The brush roller was disposed in such a way as to be an entry amount of 1.2 mm to the photoreceptor [1], and rotated in the opposite direction to the rotation direction of the photoreceptor [1] at a peripheral speed ratio of 0.6 to the photoreceptor [1]. The brush roller was grounded via the metal shaft.

In this test machine, the lubricant abundance rate A per unit area of the surface of the photoreceptor [1] after supply of the lubricant by the lubricant supply unit and before removal of the toner by the cleaning unit and the lubricant abundance rate B per unit area of the surface of the photoreceptor [1] after removal of the lubricant by the lubricant removal unit and before development by the developing unit were measured. Then, the lubricant residual ratio (B/A) was calculated, and it was 0.6. For the measurement of the lubricant abundance rates, an X-ray photoelectron spectrometer "K-Alpha" (from Thermo Fisher Scientific Inc.) was used, and as the selective elements, zinc, tin, silicon, carbon, oxide and nitrogen were subjected to quantitative analysis. The measured amount of zinc was taken as the substitution amount. In Examples 2 to 4 and Comparative Examples 1 to 3, the lubricant abundance rates were measured in the same manner.

[Evaluation of Occurrence of Fogging in Solid White Image]

Under a high-temperature and high-humidity environment (temperature of 30° C. and humidity of 85% RH), an A4 letter chart having a printing rate of 5% was printed on 100,000 sheets continuously, and subsequently a solid white image was printed on one sheet. The letter chart and the solid white image were each printed on the sheet (s) at "photoreceptor surface electric potential−development bias=100 V" under the above conditions after image stabilization.

A microphotograph of the solid white image was subjected to image analysis so that the amount of the fixed micro toner (toner particles) was measured and quantified to calculate a blackening rate. The higher the blackening rate is, the worse the level of fogging is. More specifically, the evaluation was made with the following criteria: a blackening rate of less than 0.15% is rank "A"; a blackening rate of 0.15% or more and less than 0.20% is rank "B"; a blackening rate of 0.20% or more and less than 0.25% is rank "C"; and a blackening rate of 0.25% or more is rank "D". In the present invention, a blackening rate of less than 0.20%, namely, the rank "A" or "B", is regarded as passing the test.

Examples 2 to 4

The above evaluation was made on Examples 2 to 4 which were the same as Example 1 except that, in each of Examples 2 to 4, the organic lubricant and the inorganic lubricant shown in TABLE 1 homogeneously mixed and molded were used as the lubricant stock. The results are shown in TABLE 1.

Comparative Example 1

Comparative Example 1 was the same as Example 2 except that, in Comparative Example 1, the lubricant removal unit was not provided. More specifically, the above evaluation was made on Comparative Example 1 which was the same as Example 2 except that, in Comparative Example 1, the configuration (i.e., arrangement) shown in FIG. 2 was changed to that shown in FIG. 4.

Figure 4:
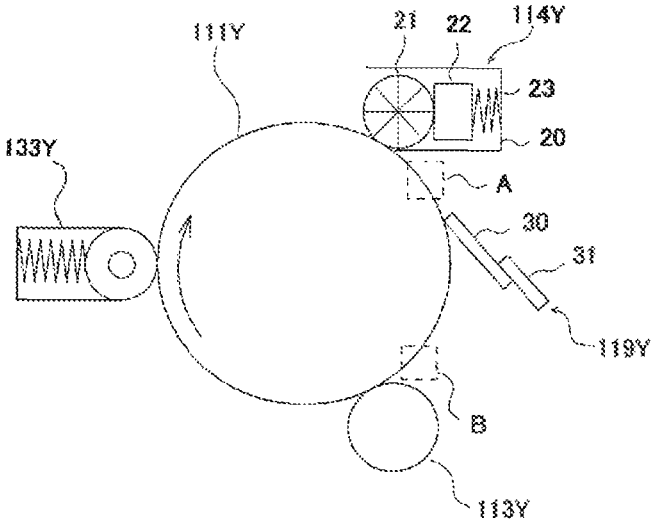
FIG. 4 is a cross-sectional view showing the configuration of the main part of an image forming apparatus used in Comparative Example 1.

In this configuration, the lubricant abundance rate B was, as shown in FIG. 4, the lubricant abundance rate per unit area of the surface of the photoreceptor at a point which was the downstream side of the cleaning unit and the upstream side of the charging unit.

Comparative Example 2

The above evaluation was made on Comparative Example 2 which was the same as Example 1 except that, in Comparative Example 2, 100 mass % of the organic lubricant (zinc stearate) was used as the lubricant stock.

Comparative Example 3

The above evaluation was made on Comparative Example 3 which was the same as Comparative Example 2 except that, in Comparative Example 3, the lubricant removal unit was not provided.

TABLE 1

| | LUBRICANT | | | | | | EVALUATION RESULT | |
|---|---|---|---|---|---|---|---|---|
| | ORGANIC LUBRICANT | | INORGANIC LUBRICANT | | LUBRICANT | LUBRICANT | FOGGING | |
| | ZnSt (mass %) | AlSt (mass %) | BORON NITRIDE (mass %) | TALC (mass %) | REMOVAL UNIT | RESIDUAL RATIO B/A | RANK | BLACKENING RATE (%) |
| EXAMPLE 1 | 90 | — | 10 | — | YES | 0.6 | B | 0.15 |
| EXAMPLE 2 | 80 | — | 20 | — | YES | 0.5 | A | 0.11 |
| EXAMPLE 3 | 90 | — | — | 10 | YES | 0.65 | B | 0.19 |

TABLE 1-continued

| | LUBRICANT | | | | | | EVALUATION RESULT | |
|---|---|---|---|---|---|---|---|---|
| | ORGANIC LUBRICANT | | INORGANIC LUBRICANT | | LUBRICANT | LUBRICANT | FOGGING | |
| | ZnSt (mass %) | AlSt (mass %) | BORON NITRIDE (mass %) | TALC (mass %) | REMOVAL UNIT | RESIDUAL RATIO B/A | RANK | BLACKENING RATE (%) |
| EXAMPLE 4 | — | 90 | 10 | — | YES | 0.63 | B | 0.19 |
| COMPARATIVE EXAMPLE 1 | 80 | — | 20 | — | NO | 0.8 | D | 0.3 |
| COMPARATIVE EXAMPLE 2 | 100 | — | 0 | — | YES | 0.83 | D | 0.25 |
| COMPARATIVE EXAMPLE 3 | 100 | — | 0 | — | NO | 0.85 | D | 0.31 |

*ZnSt: ZINC STEARATE
*AlSt: ALUMINUM STEARATE

As it is obvious from TABLE 1, the removability of the lubricant in Example 2 in which the lubricant was removed by the lubricant removal unit after cleaning is higher than that in Comparative Example 1 which had the same conditions as Example 2 except that no lubricant removal unit was provided.

Further, it is confirmed from TABLE 1 that the removability of the lubricant in each of Examples 1 to 4 in each of which both the organic lubricant and the inorganic lubricant were used as the lubricant is higher than that in Comparative Example 2 in which only the organic lubricant was used as the lubricant.

This application is based upon and claims the benefit of priority under 35 USC 119 of Japanese Patent Application No. 2015-093803 filed on May 1, 2015, the entire disclosure of which, including the specification, claims, drawings and abstract, is incorporated herein by reference in its entirety.

What is claimed is:

1. An image forming apparatus comprising:

a photoreceptor;

a charging unit which charges the photoreceptor;

an exposing unit which exposes the charged photoreceptor, thereby forming an electrostatic latent image;

a developing unit which develops the electrostatic latent image with a toner, thereby forming a toner image;

a transfer unit which transfers the toner image formed on the photoreceptor;

a lubricant supply unit which supplies a lubricant to a surface of the photoreceptor;

a cleaning unit which removes the toner remaining on the surface of the photoreceptor; and a lubricant removal unit which removes the lubricant from the surface of the photoreceptor, wherein the lubricant contains an organic lubricant and an inorganic lubricant, the organic lubricant is zinc stearate or aluminum stearate, and the inorganic lubricant is boron nitride or talc, the lubricant supply unit is disposed at a point which is an upstream side of the cleaning unit and a downstream side of the developing unit in a rotation direction of the photoreceptor, the lubricant removal unit is disposed at a point which is the downstream side of the cleaning unit and the upstream side of the developing unit in the rotation direction of the photoreceptor, and the lubricant removal unit is disposed to contact the surface of the photoreceptor and scrapes off the lubricant by mechanical action, and includes a removal member constituted of a brush roller.

2. The image forming apparatus according to claim 1, wherein the photoreceptor includes a protective layer containing a crosslinked cured resin composed of crosslinked polymers of polymerizable compounds.

3. The image forming apparatus according to claim 2, wherein the protective layer has a universal hardness of 280 $N/mm^2$ or more and 600 $N/mm^2$ or less.

4. The image forming apparatus according to claim 1, wherein the charging unit includes a charging roller.

5. The image forming apparatus according to claim 1, wherein the lubricant supply unit includes the lubricant which is solid and a lubricant applying member.

6. The image forming apparatus according to claim 1, wherein a content rate of the inorganic lubricant represented by Mb/(Ma+Mb) is 10 to 50 mass %, wherein Ma represents mass of the organic lubricant, and Mb represents mass of the inorganic lubricant.

7. The image forming apparatus according to claim 1, wherein the brush roller is disposed to contact the surface of the photoreceptor.

8. The image forming apparatus according to claim 1, further comprising an electricity removal unit, wherein the lubricant removal unit, the electricity removal unit, and the charging unit are disposed in this order in the rotation direction of the photoreceptor.

* * * * *